United States Patent [19]

Reisem

[11] Patent Number: 4,467,304

[45] Date of Patent: Aug. 21, 1984

[54] SATURABLE TANDEM COIL TRANSFORMER RELAY

[75] Inventor: Daniel E. Reisem, Maplewood, Minn.

[73] Assignee: Minnesota Mining and Manfacturing Company, St. Paul, Minn.

[21] Appl. No.: 453,947

[22] Filed: Dec. 28, 1982

[51] Int. Cl.[3] ..... H01F 7/08

[52] U.S. Cl. ..... 335/227; 335/234; 335/281

[58] Field of Search ..... 335/227, 229, 230, 234, 335/236, 281, 266, 268

[56] References Cited

U.S. PATENT DOCUMENTS

| | | | |
|---|---|---|---|
| 2,046,748 | 7/1936 | Hudson . | |
| 2,811,602 | 10/1957 | Rommel et al. . | |
| 3,154,728 | 10/1964 | Bordenet | 335/227 X |
| 3,461,354 | 8/1969 | Bollmeier . | |
| 3,508,121 | 4/1970 | Kobayashi et al. . | |
| 3,517,769 | 3/1971 | Pegram | 335/227 |
| 3,585,547 | 6/1971 | Sturman | 335/227 |
| 3,597,712 | 8/1971 | Nakagome et al. . | |
| 3,621,419 | 11/1971 | Adams et al. . | |
| 3,673,529 | 6/1972 | Garratt et al. . | |
| 4,321,652 | 3/1982 | Baker et al. . | |

*Primary Examiner*—George Harris

*Attorney, Agent, or Firm*—Donald M. Sell; James A. Smith; William D. Bauer

[57] ABSTRACT

An electromagnetic device having a ferromagnetic core having first and second legs and a third leg wherein opposed pole faces define a gap. A source of latching flux retains an armature in contact with one of either of the pole faces. A primary coil and a secondary coil are coupled in tandem to the first leg of the ferromagnetic core. The second leg is saturable under the cumulative flux created in the first leg when the secondary coil allows only a unidirectional flux flow in the first leg. The saturation of the second leg transfers a portion of the operating flux from the second leg to the gap operably moving the armature mounted therein.

27 Claims, 9 Drawing Figures

SATURABLE TANDEM COIL TRANSFORMER RELAY

BACKGROUND OF THE INVENTION

The present invention relates generally to magnetic remote control switches and more particularly to low voltage transformer relays.

A variety of magnetic remote control switches exist in the art. Some of these magnetic remote control switches incorporate a transformer along with an electromagnetic structure. Such a combination structure allows a switching system to be remotely controlled from low voltage switches connected to the secondary winding of the transformer. Typically these structures are then called low voltage transformer relays.

Two examples of low voltage transformer relays are described in U.S. Pat. No. 3,461,354, Bollmeier, Magnetic Remote Control Switch and U.S. Pat. No. 4,321,652, Baker et al, Low Voltage Transformer Relay. In both structures a transformer is provided within an electromagnetic structure. The transformer has a primary winding (coil) and a secondary winding (coil). The primary winding is connected to a source of alternating current, e.g., a 60 hertz power source. The electromagnetic structure contains an armature which is magnetically stable in either of two positions. The armature carries or activates a set of contacts which contains load carrying contacts. With the secondary winding of the transformer open, the electromagnetic device remains stable in its prior position. Bidirectional switches can be coupled in parallel, either directly or through an interface circuit, to the secondary winding of the electromagnetic device. The bidirectional switches can be activated to restrict the current flowing in the secondary winding to either a first or a second direction switching the transformer relay to either a first or a second position, thus operating the load carrying contacts.

A single such electromagnetic device, low voltage transformer relay, may be connected to a plurality of bidirectional switches. This connection operates fine as long as only one of the bidirectional switches is operated at any one time. However, if two, or more, bidirectional switches are simultaneously activated in opposite directions, the result is an effective short across the secondary winding of the low voltage transformer relay. With the primary winding of the low voltage transformer relay coupled to an alternating current power source, the low voltage transformer relay may switch following the waveform of the alternating current excitation power. With a positive excursion of the excitation power, the low voltage transformer relay would switch to a first position. With the next negative excusion of the excitation power, the transformer relay would switch to the second position. Again with the next positive excursion of the excitation power, the transformer relay would switch back to the first position. This resultant "chatter" is detrimental to the functioning of the low voltage transformer relay. If the excitation power is 60 hertz (common in the United States) the transformer relay would switch 120 times per second. Heat buildup caused by such rapid switching may well be detrimental to the low voltage transformer relay components in a relatively short time and may very well cause failure of the low voltage transformer relay within a few seconds of such operation.

There has been an electronic solution to the problem of low voltage transformer relay "chatter." U.S. patent application Ser. No. 332,145, Mosier, filed Dec. 18, 1981, is directed toward preventing such "chatter" by interfering with the ability of the bidirectional switch from creating an effective short across the secondary winding of the transformer relay.

SUMMARY OF THE INVENTION

The present invention provides an electromagnetic device having a ferromagnetic core having first and second legs and a third leg wherein opposed pole faces define a gap. An armature is mounted in the electromagnetic device for selective contact with either of the pole faces. A source of latching flux cooperates with the ferromagnetic core and the armature and retains the armature against either of the pole faces. A primary source of flux cooperates with the ferromagnetic core and induces a primary flux in the first leg. A secondary source of flux cooperates with the ferromagnetic core and selectively inhibits the primary flux in the first leg in one direction with respect to the first leg. The second leg is saturable under the cumulative flux created by the primary flux induced by the primary source of flux while the secondary source of flux selectively inhibits the primary flux in that one direction. In this manner the armature is retained in contact with one of the pole faces until the second leg saturates under the cumulative flux created by the primary flux induced by the primary source of flux while the secondary source of flux inhibits the primary flux in one direction in the saturable leg transferring a portion of the cumulative flux from the second leg to the third leg operatively moving the armature to a selected one of the pole faces.

It is preferable that the second leg be saturable under less flux than the first leg would be saturable. In this regard it is preferable that the second leg be of a smaller cross-sectional area than the first leg and preferable where that cross-sectional area is approximately one-half that of the first leg. In the preferred embodiment the electromagnetic device takes a plurality of cycles of the primary source of flux before the second leg becomes saturated.

In an alternative embodiment, the second leg and the third may be joined to form a contiguous member having a reduced cross-section forming both the smaller cross-section of the second leg and the opposed pole forces of the third leg.

Several unique advantages are provided by an electromagnetic device as described.

First, a magnetic solution to the "chatter" problem is provided. Since the saturable second leg of the transformer relay must become saturated with the developed flux before sufficient flux may be established across the gap, several "half-cycles" of the excitation power may be required. The saturable leg of the transformer relay may not saturate upon only one "half-cycle" of the excitation power. If not, the flux established will "build-up" over a plurality of "half-cycles" until saturation is achieved. Once saturated, the gap and armature become a lower reluctance path for the operating flux than the saturated leg. This additional operating flux in the gap is then sufficient to transfer the armature from one pole face to the other pole face.

Since several "half-cycles" are required before switching, typically from three to five half-cycles, a "shorted" secondary winding of the transformer relay will dissipate flux in the potentially saturable leg and no build-up of operating flux will occur. Hence, no switching of the transformer relay can occur with effective shorting of the secondary winding of the transformer relay. Since several cycles of the excitation power are required before the transformer relay will switch, the response time of the low voltage transformer relay will be increased slightly over the Bollmeier and Baker et al devices. However, in manually actuated switching systems, this delay, still much less than one second, will not be preceptible to the operator.

A further advantage achieved with the electromagnetic device of the present invention is the sizing required of the magnetic components. The low voltage transformer relays of Bollmeier and Baker et al must be sized to accomplish the transfer of the armature from one pole space to the other in *one* "half-cycle" of the excitation power. If sufficient magnetic flux is not established across the gap in this one "half-cycle" of excitation power, then the flux established is lost. This is directly contrasted to the electromagnetic device in the present invention wherein the operating flux is allowed to "build up" over several "half-cycles" of the excitation power before sufficient flux is established across the gap to enable the armature to be transferred from one pole face to the other. Since the flux may be allowed to build up over several "half-cycles", the flux required to move the armature and hence switch the transformer relay need not necessarily be present in one "half-cycle" of the excitation power. Several successive additive operating fluxes are available to transfer the armature and switch the transformer relay. Thus, generally smaller electromagnetic components for the low voltage transformer relay may be used. In addition, cost is reduced over earlier transformer relay designs by the placement of both primary and secondary coils on a common coil form and leg of the ferromagnetic core.

BRIEF DESCRIPTION OF THE DRAWINGS

The foregoing advantages, construction and operation of the present invention will become more readily apparent from the following description and accompanying drawings in which.

DETAILED DESCRIPTION OF THE PREFERRED EMBODIMENTS

Figure 1:
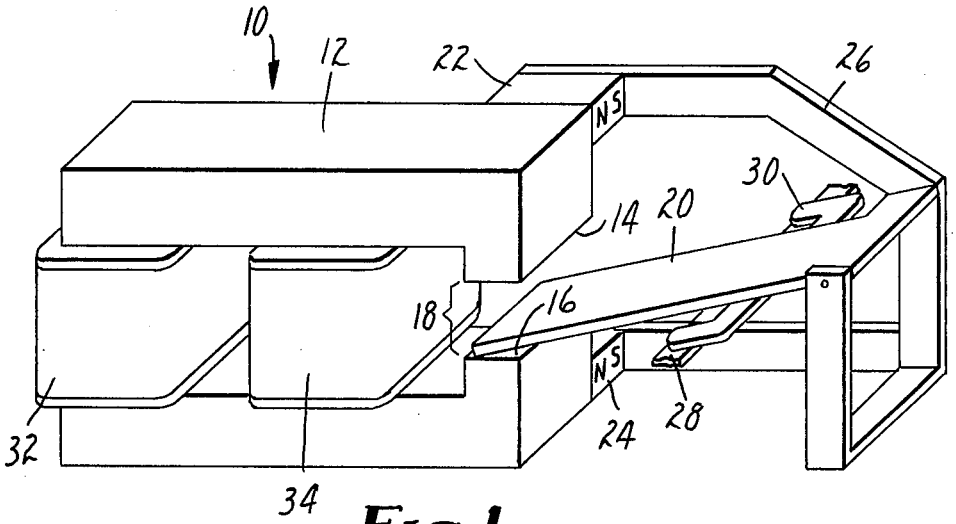
FIG. 1 PRIOR ART
FIG. 1 is an isometric view of a prior art low voltage transformer relay.

FIG. 1 is an exemplary representation of a low voltage transformer relay of the type described in Baker et al. The low voltage transformer relay 10 is constructed from a ferromagnetic core 12. The ferromagnetic core 12 has opposed pole faces 14 and 16 defining a gap 18. An armature 20 is mounted for selective contact with either of the pole faces 14 or 16. Permanent magnets 22 and 24 couple with the ferromagnetic core 12 and flux return bracket 26 to latch the armature 20 and retain it against one of the pole faces 14 or 16. One or more contacts 28 and 30 may be mounted on the armature to provide the capability for a load switch. In addition to the leg of the ferromagnetic core 12 containing the gap 18, a primary coil (winding) 32 is wound around one leg of the ferromagnetic core and a secondary coil (winding) 34 is wound around a separate leg of the ferromagnetic core 12. Further details of the construction of such a prior art electromagnetic device may be had by reference to U.S. Pat. No. 3,461,354, Bollmeier, Magnetic Remote Control Switch and U.S. Pat. No. 4,321,652, Baker et al, Low Voltage Transformer Relay, both of which are hereby incorporated by reference.

Figure 2:
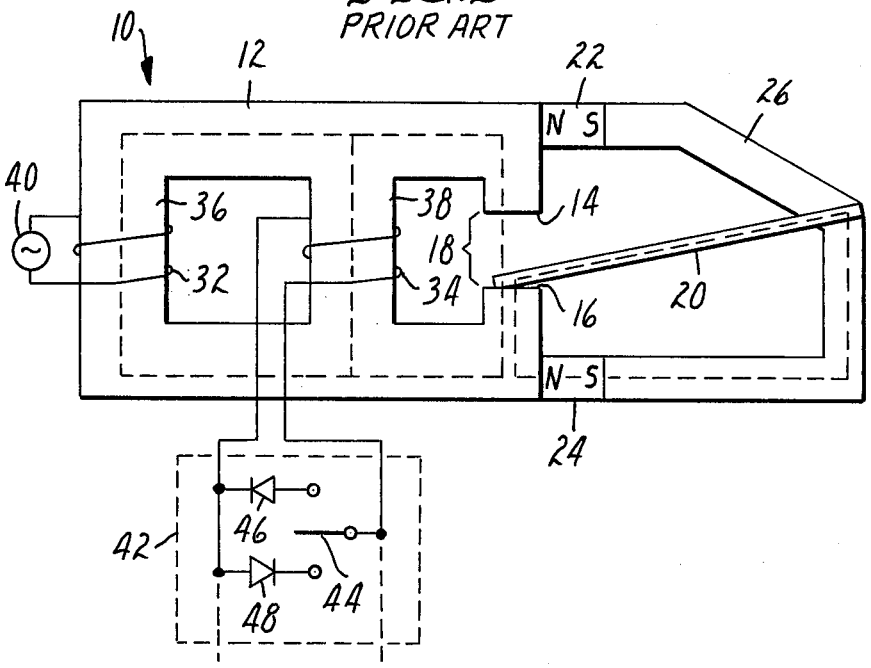
FIG. 2 PRIOR ART
FIG. 2 is a magnetic schematic of a prior art low voltage transformer relay without bidirectional switch activation.

Details of the operation of the low voltage transformer relay 10 of FIG. 1 may be more easily had by reference to the magnetic schematic of FIG. 2. The electromagnetic device 10 has a ferromagnetic core 12 having opposed pole faces 14 and 16 defining a gap 18. Armature 20 is mounted to flux return bracket 26 for selective contact with either pole face 14 or 16. Latching magnets 22 and 24 retain the armature 20 against either one of the pole faces 14 or 16. Primary coil 32 is wound around leg 36 of the ferromagnetic core 12 while the secondary coil 34 is wound around leg 38 of the ferromagnetic core 12. For ease of illustration contacts 28 and 30 are not shown. Primary coil 32 is coupled to an alternating current power source 40 while secondary coil 34 is coupled to a bidirectional switch 42. The bidirectional switch 42 consists of a single pole, double throw, center off, momentary contact switch 44 and oppositely connected diodes 46 and 48. When the switch 44 is thrown to the upper position, diode 46 restricts flux in leg 38 of the ferromagnetic core 12 to one direction while when the switch is thrown to the lower position diode 48 restricts flux in leg 38 of the ferromagnetic core 12 to the opposite direction.

With bidirectional switch 42 as illustrated in FIG. 2 not being activated, the alternating flux created in leg 36 of the ferromagnetic core 12 moves easily in both directions through leg 38 of the ferromagnetic core. Since the gap 18 represents a higher reluctance than leg 38, most of the flux generated by the primary winding 32 will transverse leg 38. Armature 20 is illustrated in contact with pole face 16. Latching magnet 24 is a source of latching flux which travels through the ferromagnetic core 12, the armature 20 and flux return bracket 26 to retain the armature 20 against pole face 16. Latching magnet 22 is a source of latching flux which travels a longer path through the ferromagnetic core 12, the armature 20 and the flux return bracket 26 to aid in retaining the armature 20 against pole face 16. Since the latching flux is reduced in magnitude by the longer path through the ferromagnetic core 12, it is not separately illustrated in FIG. 2.

Figure 3:
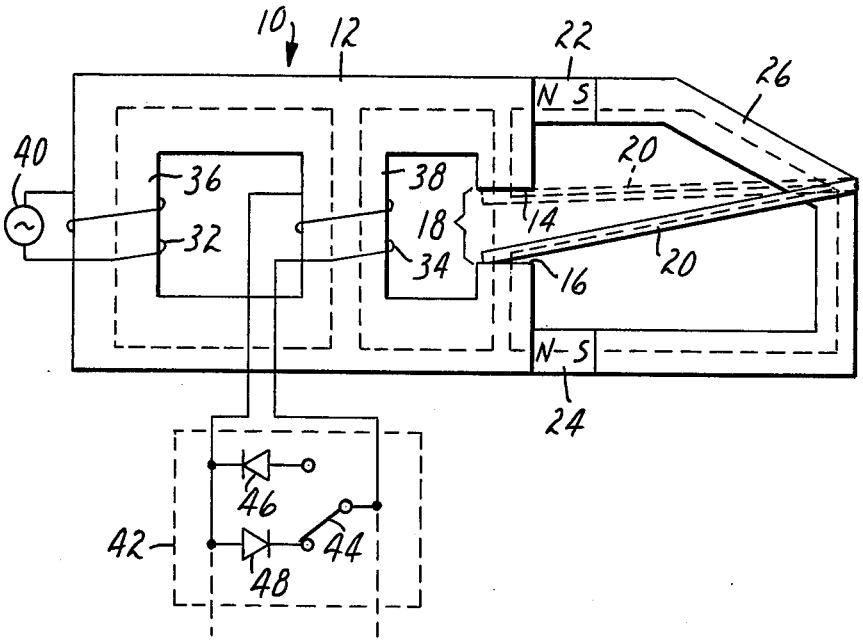
FIG. 3 PRIOR ART
FIG. 3 is a magnetic schematic of a prior art low voltage transformer relay with bidirectional switch being activated in one direction.

FIG. 3 illustrates the operation of the electromagnetic device 10 when the single pole, double throw switch 44 of the bidirectional switch 42 is thrown to the lower position, activating diode 48. So activated, secondary coil 34 makes leg 38 of the ferromagnetic core 12 a high reluctance to the operating flux from primary coil 32. Since the operating flux in leg 36 can no longer easily traverse leg 38, much of that flux is transferred through the gap 18 and, when it is large enough to overcome the latching flux created by latching magnets 22 and 24, will actuate movement of the armature 20 from pole face 16 to pole face 14.

From the above discussion it can be readily seen that if the secondary coil 34 is shorted, either directly or through the simultaneous actuation in opposite directions of multiple bidirectional switches 42, that the flux across the gap 18 will follow the waveform of the operating flux created by the primary coil 32. With every excursion of the alternating current power source 40, the armature 20 will be switched from pole face to pole face (14 and 16). This rapid switching of the armature 20 is the resultant "chatter" which is to be avoided.

Figure 4:
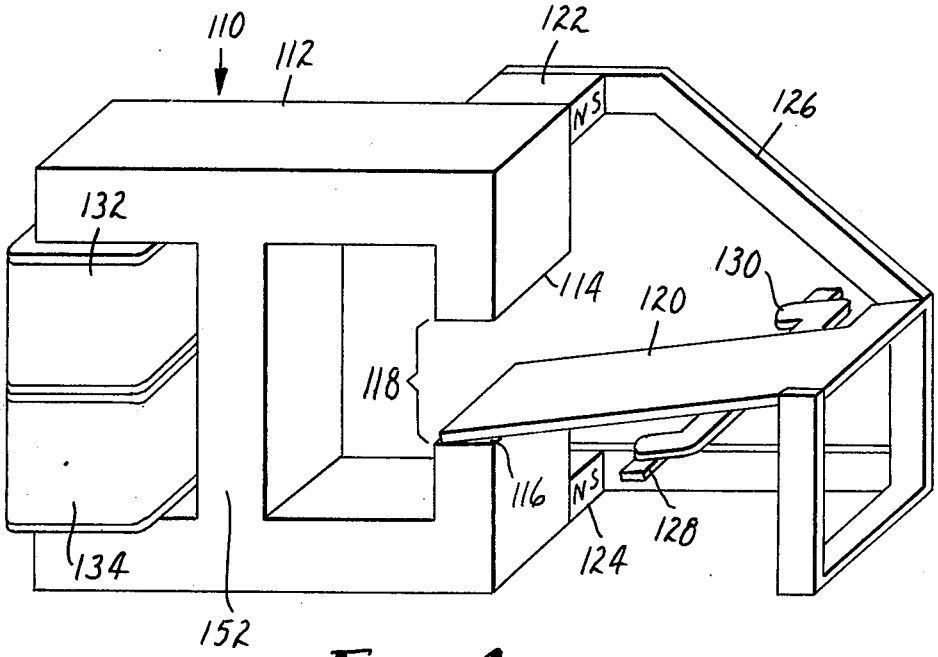
FIG. 4 is an isometric view of the electromagnetic device of the present invention.

FIG. 4 illustrates the electromagnetic device 110 of the present invention. Again, as in FIG. 1, a ferromagnetic core 112 is provided with opposed pole faces 114 and 116 defining a gap 118. An armature 120 is mounted for selective contact with either of pole faces 114 or 116. Latching magnets 122 and 124 retain the armature 120 against either of the pole faces 114 or 116. Flux return bracket 126 connects latching magnets 122 and 124 with the armature 120 and the ferromagnetic core 112. Contacts 128 and 130 illustrate the ability to connect a load switch to the armature 120. Also again, a primary coil 132 and a secondary coil 134 are provided. However, in contrast with the low voltage transformer relay 10 of FIG. 1, the electromagnetic device 110 of FIG. 4 has a primary coil 132 and a secondary coil 134 mounted in tandem on a first leg 150 of the ferromagnetic core 112. This leaves a second leg 152 of the ferromagnetic core 112 without any coil windings. Leg 152 of ferromagnetic core 112 is sized and designed to be saturable under the operating flux produced by primary coil 132 when secondary coil 134 has been restricted to a single direction.

Figure 5:
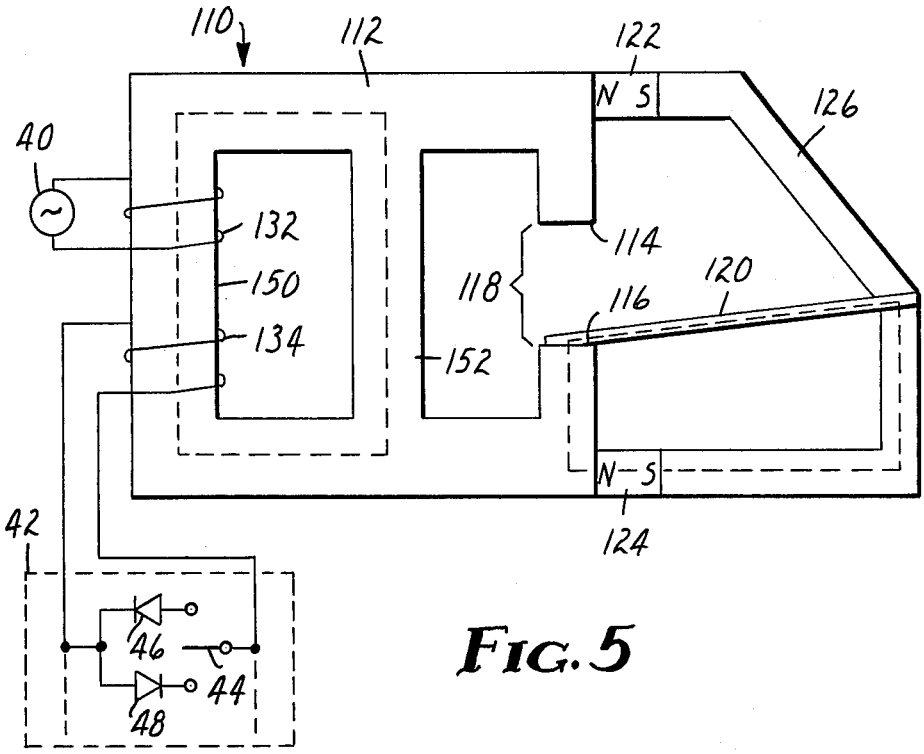
FIG. 5 is a magnetic schematic of an electromagnetic device of the present invention without bidirectional switch activation.

Operation of the electromagnetic device in FIG. 4 can be more readily understood by reference to the magnetic schematic in FIG. 5. The electromagnetic device 110 has a ferromagnetic core 112 with opposed pole faces 114 and 116 defining a gap 118. Armature 120 is mounted for selective contact to either of pole faces 114 or 116. Latching magnets 122 and 124 cooperate with flux return bracket 126 to retain the armature 120 against either of pole faces 114 and 116. Primary coil 132 and secondary coil 134 are wound around first leg 150 of the ferromagnetic core 112. Primary coil 132 is connected to an alternating current power source 40. Secondary coil 134 is coupled to a bidirectional switch 42 which consists of a single pole, double throw, center off, momentary contact switch 44 and diodes 46 and 48. The ferromagnetic core 112 also has a second leg 152 which is saturable under the influence of the operating flux created by primary coil 132 when restricted to a single direction. For purposes of the magnetic schematic, second leg 152 is shown having a reduced cross-section from first leg 150 to illustrate the saturability. With the bidirectional switch 42 not being actuated, the operating flux supplied to the ferromagnetic core 112 by the primary winding 132 transverses through first leg 150 and second leg 152. Little operating flux transverses the gap 118 since the gap 118 represents a much larger reluctance than second leg 152. Latching magnets 122 and 124 provide latching flux through ferromagnetic core 112, armature 120 and flux return bracket 126 to retain the armature 120 against pole face 116.

Figure 6:
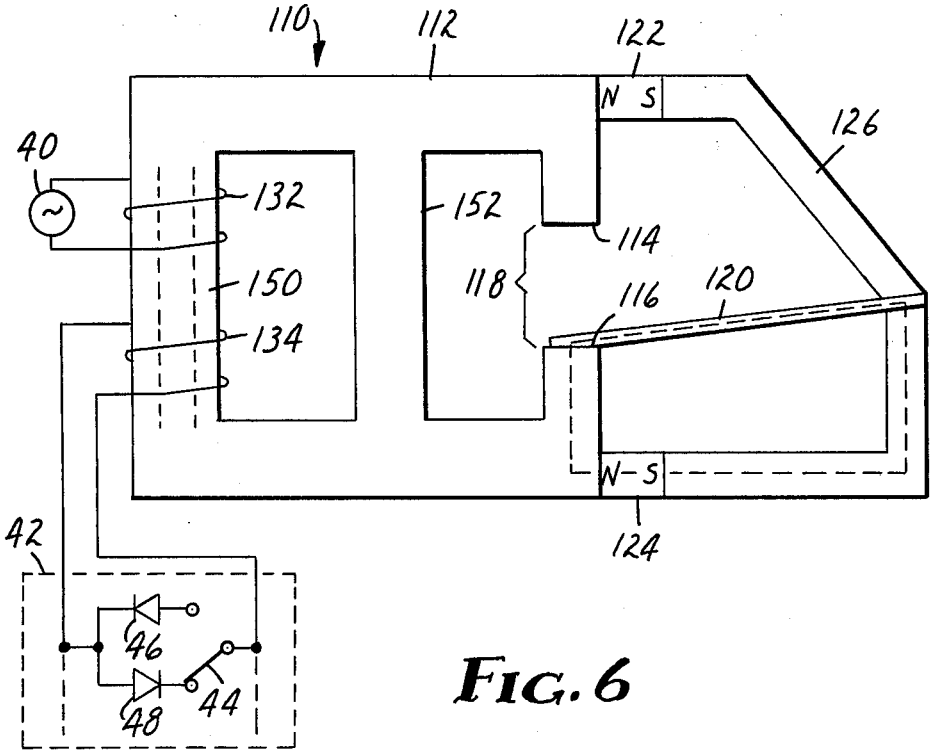
FIG. 6 is a magnetic schematic of the electromagnetic device of the present invention with a bidirectional switch being activated in one direction but without magnetic saturation.

Operation of the electromagnetic device 110 when the bidirectional switch is activated by throwing single pole, double throw switch 24 to the lower position activating diode 48 can be more easily seen by reference to FIG. 6. As in FIG. 5, latching magnets 122 and 124 (mainly latching magnet 124) are a source of latching flux which flows through ferromagnetic core 112, armature 120 and flux return bracket 126 to retain the armature 120 against pole face 116. With the activation of bidirectional switch 42, the secondary coil 134 provides a secondary source of flux in first leg 150 of the ferromagnetic core 112 in one direction. Thus, the flow of operating flux produced by primary coil 132 is greatly diminished (and preferably cancelled) in one direction of first leg 150. While it is within the scope of the present invention to provide an electromagnetic device 110 in which second leg 152 saturable under the first half-cycle of the alternating current power source 40, it is preferred that a plurality of half-cycles of the alternating current power source 40 be required before enough operating flux is established from first leg 150 to enable second leg 152 to become saturated. For purposes of illustration, FIG. 6 is shown having bidirectional switch 42 activated but without second leg 152 reaching saturation. As long as second leg 152 is not saturated, second leg 152 still provides a path of lower reluctance than gap 118. Although additional flux may flow through gap 118 as second leg 152 approaches saturation, the flow of flux across gap 118 is still not sufficient to counteract the source of latching flux created by latching magnets 122 and 124.

Figure 7:
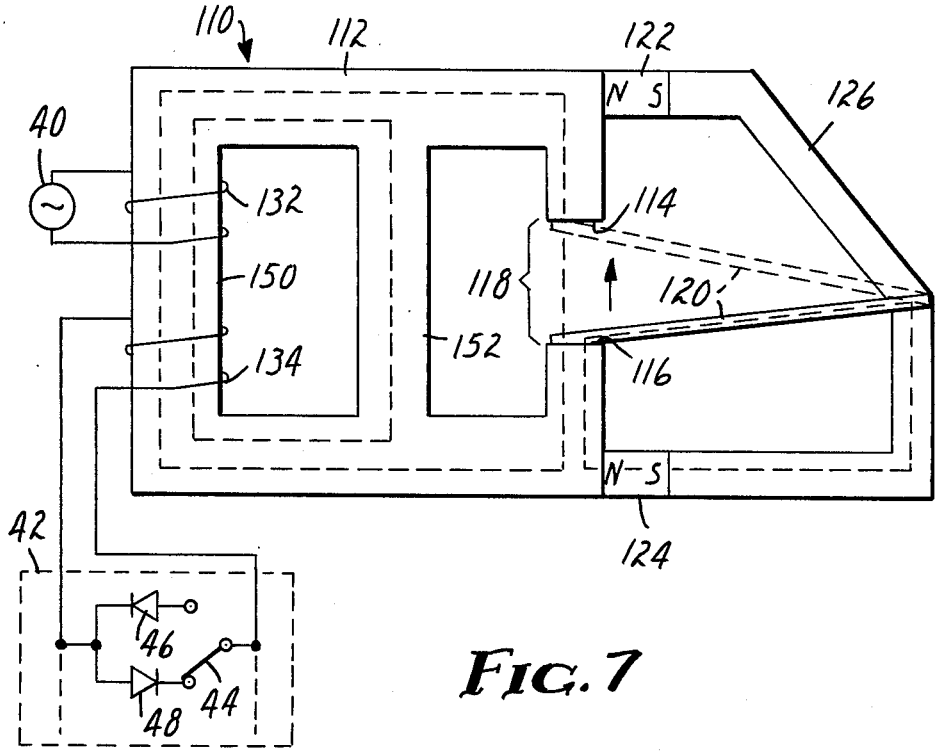
FIG. 7 is a magnetic schematic similar to FIG. 6 but with saturation.

FIG. 7 represents a schematic diagram of the electromagnetic device 110 in which saturation of second leg 152 is achieved, preferably through successive half-cycles of operating flux produced by primary coil 132 supplied from the alternating current power source 40. As second leg 152 becomes saturated its reluctance sharply increases. As its reluctance increases, a portion of the operating flux supplied to the ferromagnetic core 112 by primary coil 132 is transferred to the leg of the ferromagnetic core 112 containing gap 118. When the flux flowing across gap 118 is sufficient to overcome the latching flux provided by latching magnets 122 and 124, armature 120 is operably moved from pole face 116 to pole face 114 where it is retained by latching magnet 122.

Figure 8:
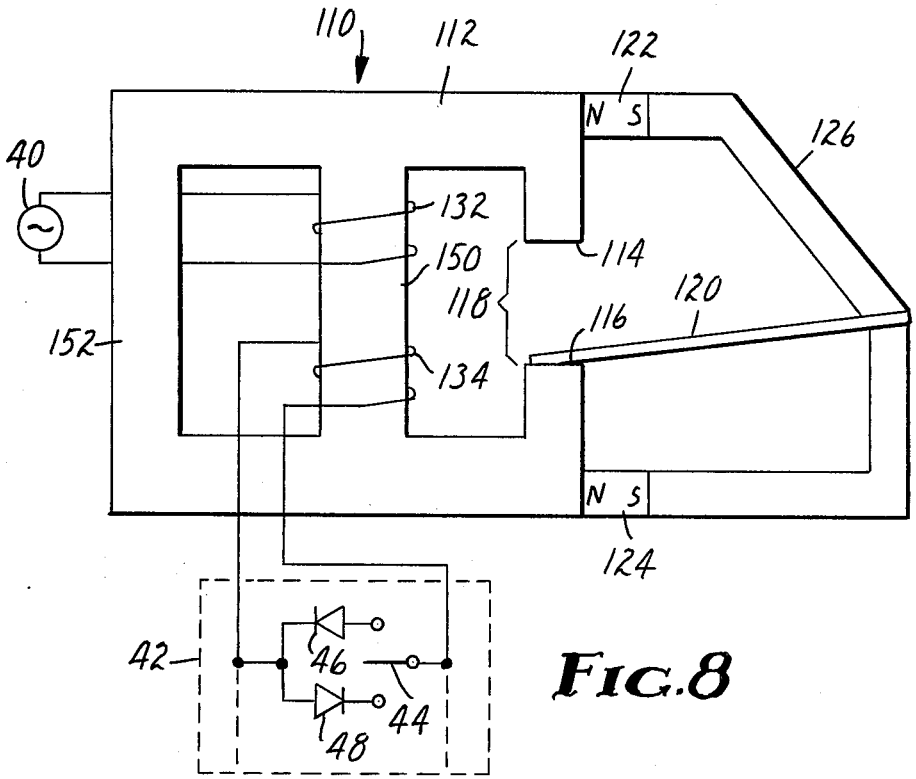
FIG. 8 is an alternative embodiment of the electromagnetic device of the present invention.

FIG. 8 is a magnetic schematic of an alternative embodiment of the electromagnetic device 110 of the present invention. The electromagnetic device 110 illustrated in FIG. 8 is very similar to the electromagnetic device 110 illustrated in FIGS. 4 through 7. Both devices contain a primary coil 132 and a secondary coil 134 mounted in tandem on a first leg 150. Further, both electromagnetic devices 110 have a second leg 152 which is saturable under the unidirectional operating flux provided by primary coil 132. The difference between the electromagnetic device 110 disclosed in FIGS. 4 through 7 and the electromagnetic device 110 in FIG. 8 is the positional relationship between the first leg 150 and the second leg 152. Although the structure as illustrated in FIGS. 4 through 7 with the second leg 152 located nearer the gap 118 is operable, the structure illustrated in FIG. 8 is an alternative embodiment. There the first leg 150 is located between the portion of the ferromagnetic core 112 containing the gap 118 and the second leg 152 which is saturable. The embodiment illustrated in FIG. 8 is preferred, probably due to the separation of the saturating flux and the operating flux.

Figure 9:
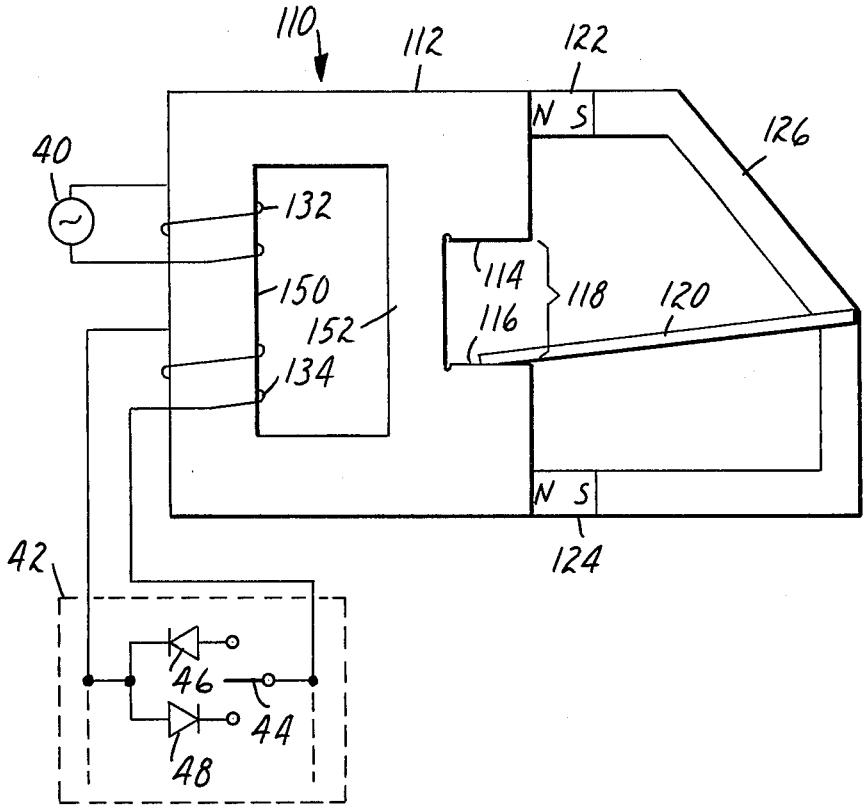
FIG. 9 is another alternative embodiment of the electromagnetic device of the present invention.

FIG. 9 illustrates still another alternative embodiment of the electromagnetic device 110 of the present invention. Again, the electromagnetic device 110 in FIG. 9 contains a ferromagnetic core 112 having opposed pole faces 114 or 116 defining a gap 118. Armature 120 is mounted for selective contact with either pole faces 114 or 116 and is retained against one of the pole faces 114 or 116 by latching magnets 122 and 124 coupled with flux return bracket 126. Primary coil 132, coupled to an alternating current power source 40, is mounted in tandem with a secondary coil 134 on first leg 150 of ferromagnetic core 112. Bidirectional switch 42 containing a single pole, double throw, center off, momentary contact switch 44 and diodes 46 and 48 are coupled to secondary coil 134. Also a secondary leg 152 is provided which is saturable under the unidirectional operating flux supplied by primary coil 132. The embodiment described in FIG. 9 illustrates that the pole faces 114 and 116 defining the gap 118 may be brought in close proximity to the second leg 152 which is saturable. As long as second leg 152 is not saturated the operating flux may readily flow through it and not across the gap 118. However, when second leg 152 saturates, its reluctance increases and enough of the operating flux from the primary coil 132 will flow across the gap 118 to operate the armature 120.

Thus, it can be seen that there has been shown and described a novel, saturable, electromagnetic device. It is to be understood, however, that various changes, modifications or substitutions in the form of the details of the described electromagnetic device can be made by those skilled in the art without departing from the scope of the invention as defined by the following claims.

What is claimed is:

1. An electromagnetic device, comprising:

a ferromagnetic core having first and second legs and a third leg wherein opposed pole faces define a gap;

an armature mounted in said electromagnetic device for selective contact with either of said pole faces;

a source of latching flux cooperating with said ferromagnetic core and said armature for retaining said armature against either of said pole faces;

a primary source of flux cooperating with said ferromagnetic core for inducing a primary flux in said first leg; and a secondary source of flux cooperating with said ferromagnetic core for selectively inhibiting said primary flux in said first leg in one direction with respect to said first leg;

said second leg being saturable under the cumulative flux created by said primary flux induced by said primary source of flux while said secondary source of flux selectively inhibits said primary flux in said one direction;

whereby said armature is retained in contact with one of said pole faces until said second leg saturates under said cumulative flux created by said primary flux induced by said primary source of flux while said secondary source of flux inhibits said primary flux in said one direction transferring a portion of said cumulative flux from said second leg to said third leg operatively moving said armature to a selected one of said pole faces.

2. An electromagnetic device as in claim 1 wherein said second leg is saturable under less flux than said first leg.

3. An electromagnetic device as in claim 2 wherein said second leg is of a smaller cross-sectional area than said first leg.

4. An electromagnetic device as in claim 3 wherein the cross-sectional area of said second leg is approximately one-half of the cross-sectional area of said first leg.

5. An electromagnetic device as in claim 1 wherein said primary flux is an alternating flux cycling at a predetermined frequency and wherein a plurality of cycles of said primary flux induced by said primary source of operating flux are required while said secondary source of flux cancels said primary flux in said one direction before said second leg becomes saturated.

6. An electromagnetic device as in claim 5 wherein said secondary source of flux is capable of cancelling said primary flux selectively in either direction in said first leg.

7. An electromagnetic device as in claim 6 wherein said source of latching flux is a steady-state source of flux.

8. An electromagnetic device as in claim 7 wherein said primary source of flux is a primary coil wound around said first leg and wherein said secondary source of flux is a secondary coil wound around said first leg, said primary coil adapted to be coupled to an alternating current power source.

9. An electromagnetic device as in claim 8 wherein said secondary source of flux inhibits said primary flux in said one direction by allowing only unidirectional current flow in said secondary coil.

10. An electromagnetic device comprising:

a ferromagnetic core having first and second legs and a third leg wherein opposed pole faces define a gap;

an armature mounted in said electromagnetic device for selective contact with either of said pole faces;

a source of latching flux cooperating with said ferromagnetic core and said armature for retaining said armature against either of said pole faces;

a primary coil wounc around said first leg and adapted to be connected to an alternating current power source, said primary coil for inducing a primary flux in said first leg; and a secondary coil wound around said first leg and adapted to be selectively connected to a unidirectional current director, said secondary coil for selectively inhibiting said primary flux in said first leg in one direction with respect to said first leg;

said second leg being saturable under the cumulative flux created by said primary flux induced by said primary coil while said secondary coil inhibits said primary flux in said one direction;

whereby said armature is retained in contact with one of said pole faces until said second leg saturates under said cumulative flux created by said primary flux induced by said primary coil while said secondary coil inhibits said primary flux in said one direction transferring a portion of said cumulative flux from said second leg to said third leg operatively moving said armature to a selected one of said pole faces.

11. An electromagnetic device as in claim 10 wherein said second leg is saturable under less flux than said first leg.

12. An electromagnetic device as in claim 11 wherein said second leg is of a smaller cross-sectional area than said first leg.

13. An electromagnetic device as in claim 12 wherein the cross-sectional area of said second leg is approximately one-half of the cross-sectional area of said first leg.

14. An electromagnetic device as in claim 10 wherein a plurality of cycles of said alternating current power source are required before said cumulative flux becomes sufficient to saturate said second leg of said ferromagnetic core.

15. An electromagnetic device as in claim 14 wherein said secondary coil is capable of inhibiting said primary flux selectively in either direction in said first leg.

16. An electromagnetic device as in claim 15 wherein said source of latching flux is a steady-state source of flux.

17. An electromagnetic device as in claim 16 wherein said primary flux is selectively inhibited in said one direction in said first leg by allowing only unidirectional current flow in said secondary coil.

18. An electromagnetic device as in claim 17 wherein said second leg is positioned between said first leg and said third leg.

19. An electromagnetic device, comprising:

a ferromagnetic core having first and second legs and a third leg wherein opposed pole faces define a gap;

an armature mounted in said electromagnetic device for selective contact with either of said pole faces;

a source of latching flux cooperating with said ferromagnetic core and said armature for retaining said armature against either of said pole faces;

a primary source of flux cooperating with said ferromagnetic core for inducing a primary flux in said first leg; and a secondary source of flux cooperating with said ferromagnetic core for selectively inhibiting said primary flux in said first leg in one direction with respect to said first leg;

said second leg and said third being joined to form a contiguous member of said ferromagnetic core with said member having a reduced cross-section forming said second leg and a portion having said opposed pole faces forming said third leg;

said second leg being saturable under a cumulative flux created by said primary flux induced by said primary source of flux while said secondary source of flux selectively inhibits said primary flux in said one direction;

whereby said armature is retained in contact with one of said pole faces until said second leg saturates under said cumulative flux created by said primary flux induced by said primary source of flux while said secondary source of flux inhibits said primary flux in said one direction transferring a portion of said cumulative flux from said second leg to said third leg operatively moving said armature to a selected one of said pole faces.

20. An electromagnetic device as in claim 19 wherein said second leg is saturable under less flux than said first leg.

21. An electromagnetic device as in claim 20 wherein said second leg is of a smaller cross-sectional area than said first leg.

22. An electromagnetic device as in claim 21 wherein the cross-sectional area of said second leg is approximately one-half of the cross-sectional area of said first leg.

23. An electromagnetic device as in claim 19 wherein said primary flux is an alternating flux cycling at a predetermined frequency and wherein a plurality of cycles of said primary flux induced by said primary source of operating flux are required while said secondary source of flux cancels said primary flux in said one direction before said second leg becomes saturated.

24. An electromagnetic device as in claim 23 wherein said secondary source of flux is capable of cancelling said primary flux selectively in either direction in said first leg.

25. An electromagnetic device as in claim 24 wherein said source of latching flux is a steady-state source of flux.

26. An electromagnetic device as in claim 25 wherein said primary source of flux is a primary coil wound around said first leg and wherein said secondary source of flux is a secondary coil wound around said first leg, said primary coil adapted to be coupled to an alternating current power source.

27. An electromagnetic device as in claim 26 wherein said secondary source of flux inhibits said primary flux in said one direction by allowing only unidirectional current flow in said secondary coil.

* * * * *

UNITED STATES PATENT AND TRADEMARK OFFICE

CERTIFICATE OF CORRECTION

PATENT NO. : 4,467,304

DATED : August 21, 1984

INVENTOR(S) : Daniel E. Reisem

It is certified that error appears in the above—identified patent and that said Letters Patent is hereby corrected as shown below:

Col. 8, line 44, "wounc" should read --wound--.

Signed and Sealed this

*Twelfth* Day of *February 1985*

[SEAL]

*Attest:*

DONALD J. QUIGG

*Attesting Officer* *Acting Commissioner of Patents and Trademarks*